US008181276B2

(12) United States Patent
Homer

(10) Patent No.: US 8,181,276 B2
(45) Date of Patent: May 22, 2012

(54) GLOVE REINFORCEMENT AND METHOD THEREOF

(75) Inventor: Peter K. Homer, Southwest Harbor, ME (US)

(73) Assignee: Flagsuit LLC, Southwest Harbor, ME (US)

( * ) Notice: Subject to any disclaimer, the term of this patent is extended or adjusted under 35 U.S.C. 154(b) by 1032 days.

(21) Appl. No.: 12/150,641

(22) Filed: Apr. 30, 2008

(65) Prior Publication Data

US 2008/0271219 A1 Nov. 6, 2008

Related U.S. Application Data

(60) Provisional application No. 60/915,444, filed on May 2, 2007.

(51) Int. Cl.
*A41D 19/00* (2006.01)

(52) U.S. Cl. ..... 2/161.6

(58) Field of Classification Search ..... 2/16, 20, 2/161.1, 161.6; 128/878–880; 602/5, 12, 602/21, 22

See application file for complete search history.

(56) References Cited

U.S. PATENT DOCUMENTS

| | | | | | |
|---|---|---|---|---|---|
| 1,773,108 | A * | 8/1930 | Lichty et al. | 128/880 |
| 1,837,691 | A * | 12/1931 | Thigpen | 602/22 |
| 3,170,460 | A * | 2/1965 | Stilson | 602/22 |
| 4,366,813 | A | 1/1983 | Nelson | 128/80 |
| 4,675,914 | A | 6/1987 | Mitchell | 2/161 A |
| 4,781,178 | A | 11/1988 | Gordon | 128/77 |
| 4,805,606 | A | 2/1989 | McDavid, III | 128/80 |
| 5,113,526 | A | 5/1992 | Wang et al. | 2/2 |
| 5,191,903 | A | 3/1993 | Donohue | 128/879 |
| 5,346,462 | A * | 9/1994 | Barber | 602/22 |
| 5,384,083 | A | 1/1995 | Dawn et al. | 264/130 |
| 5,624,388 | A | 4/1997 | Lehr | 602/20 |
| 5,802,614 | A | 9/1998 | Melone, Jr. | 2/161.1 |
| 5,891,073 | A | 4/1999 | Deirmendjian et al. | 602/27 |
| 5,891,079 | A | 4/1999 | Barnes | 602/61 |
| 6,000,059 | A | 12/1999 | Abts | 2/161.6 |
| 6,139,514 | A | 10/2000 | Benson | 602/63 |
| 6,163,885 | A | 12/2000 | Webb | 2/166 |
| 6,557,177 | B2 | 5/2003 | Hochmuth | 2/159 |
| 6,719,906 | B1 * | 4/2004 | Malisz et al. | 210/639 |
| 6,783,507 | B1 | 8/2004 | Fisher | 602/22 |

OTHER PUBLICATIONS

Notification of Transmittal of International Preliminary Examination Report dated Aug. 20, 2009 for corresponding PCT application No. PCT/US08/05594.

Newman, Dava; "*Astronaut Bio-Duit System for Exploration Class Missions*"; Bimonthly Report, Phase II, NASA Institute for Advanced Concepts and the Massachusetts Institute of Technology, May 2005, pp. 1-2.

(Continued)

*Primary Examiner* — Katherine Moran

(74) *Attorney, Agent, or Firm* — Ohlandt, Greeley, Ruggiero & Perle, LLP

(57) ABSTRACT

A glove having one or more reinforcements affixed thereon that reduce restriction of movement of fingers of a user. The reinforcements cross to form at least one X-shaped pattern when projected on a plane of motion of an interphalangeal joint of the fingers. The one or more reinforcements are located substantially on one or both sides of the interphalangeal joint of the fingers. The X-shaped pattern is substantially centered over an axis of rotation of the interphalangeal joint.

9 Claims, 7 Drawing Sheets

OTHER PUBLICATIONS

Waldie, James M.A.; "*Mechanical Counter Pressure Space Suites: Advantages, Limitations and Concepts for Martian Exploration*"; The Mars Society, 2005, 16 pages.

http://apollomaniacs.web.infoseek.co.jp/apollo/spacesuit/aps09.jpg, 1 pg., Apr. 23, 2008.

http://www.ketzer.com/original_movie_props/armageddon_gloves.html, 2 pps., Apr. 23, 2008.

http://us.st11.yimg.com/us.st.yimg.com/I/spacestore_1999_6601536, 1 pg, Apr. 23, 2008.

http://www.hightechscience.org/sokol_space_glove.htm, 5 pps., Apr. 23, 2008.

http://ketzer.com/space_flown_artifacts/sokol_gloves.html, 1 pg., Apr. 23, 2008.

* cited by examiner

GLOVE REINFORCEMENT AND METHOD THEREOF

CROSS REFERENCE TO RELATED PATENT APPLICATIONS

The present application is a Utility application that claims priority of U.S. Provisional Application No. 60/915,444 filed on May 2, 2007. The provisional application is hereby incorporated herein by reference in its entirety.

BACKGROUND OF THE INVENTION

1. Field of the Invention

The present disclosure relates to a glove reinforcement and a method of reinforcing a glove that enhances finger dexterity and reduces unfavorable restriction to movement.

2. Description of Related Art

Traditional methods used to construct and reinforce a glove have a tendency to restrict the bending movement of a user's fingers. For example, an internally pressurized glove is manufactured to restrain against axial elongation and radial expansion however, traditional methods used to reinforce the gloves are prone to bunching and often prevent or severely limit articulating joints from bending. Traditional internally pressurized gloves also lack the ability to resist internal pressure while allowing the interphalangeal joints in the finger to move freely which leads to rapid exhaustion of the energy of a user. Traditional gloves also lack resistance to wear, have poor grip and are awkwardly shaped which reduces manual dexterity of the user.

Accordingly, a need exists for a method of reinforcing or otherwise enhancing the performance of a glove that does not restrict the bending movement of a user's fingers. A method of reinforcing a glove is also needed in which reinforcements are affixed to the glove that allow the glove to resist internal pressure while providing freedom for the articulating joints of a finger to bend and move freely. There is yet a further need for a method of reinforcing a glove that increases strength, improves resistance to wear, enhances finger dexterity, and favorably modifies the grip or surface coefficient of friction of the glove.

SUMMARY OF THE INVENTION

The present disclosure provides a glove reinforcement that reduces restriction of movement of a user's fingers. The glove has one or more reinforcements affixed thereto which provide a favorable attribute such as added strength, resistance to wear, or enhanced coefficient of friction. The one or more reinforcements cross to form at least one X-shaped pattern when projected on a plane of motion of an interphalangeal joint of the user's fingers. The one or more reinforcements are located on one or both sides of each interphalangeal joint of the user's fingers. The X-shaped pattern is substantially centered over an axis of rotation of the interphalangeal joint. The one or more reinforcements may cross to form at least one palmar X-shaped pattern and at least one dorsal X-shaped pattern.

The present disclosure also provides a method of reinforcing a glove that includes affixing a plurality of individual reinforcements to discrete points on a dorsal surface of a glove. A plurality of individual reinforcements are also affixed to discrete points on a palmar surface of the glove. The edges of the dorsal surface of the glove are attached to the edges of the palmar surface of the glove so that corresponding reinforcements form at least one X-shaped pattern when projected on a plane of motion of an interphalangeal joint. The one or more reinforcements are located on one or both sides of each interphalangeal joint of the user's fingers. The X-shaped pattern is substantially centered over an axis of rotation of the interphalangeal joint.

The above-described and other features and advantages of the present disclosure will be appreciated and understood by those skilled in the art from the following detailed description, drawings, and appended claims.

DETAILED DESCRIPTION OF THE INVENTION

Figure 1:
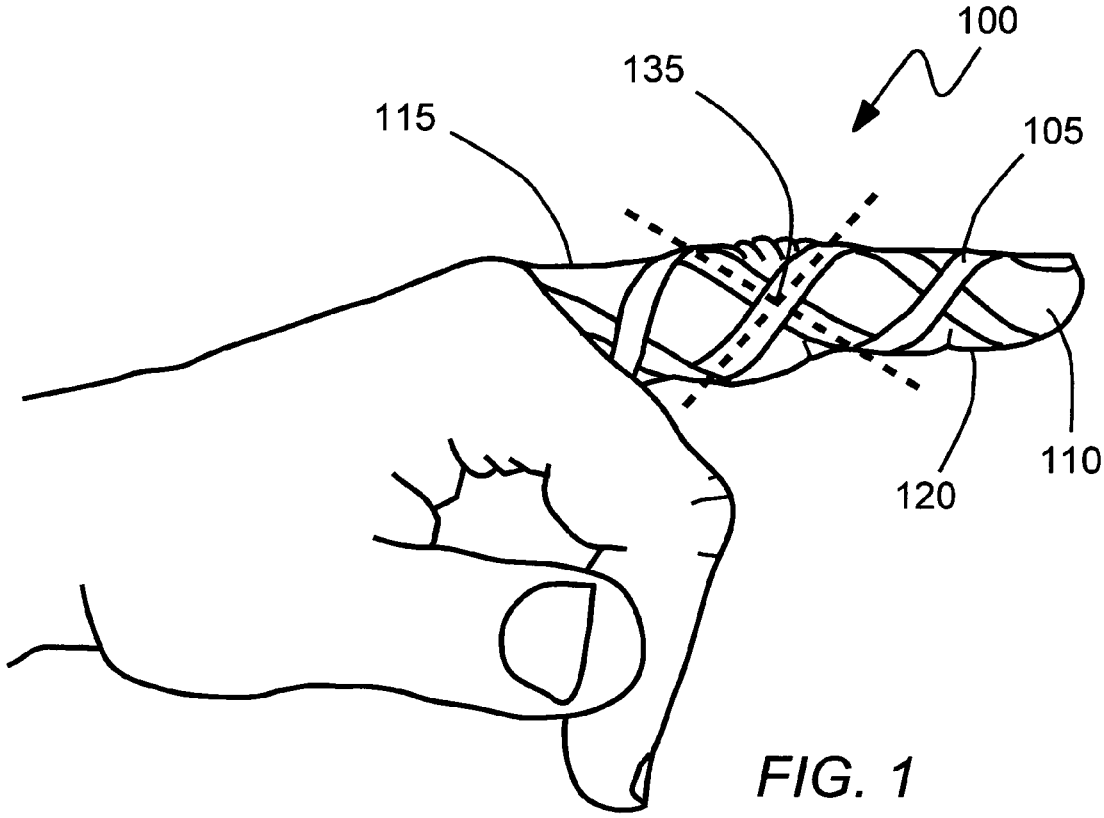
FIG. 1 is a side view of a hand with an exemplary embodiment of an arrangement of reinforcements of the present disclosure thereon.
Figure 2:
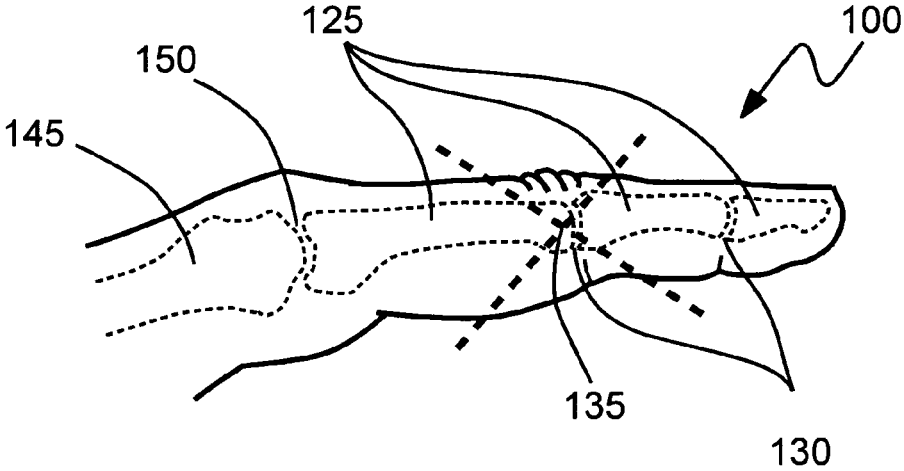
FIG. 2 is a side view of a finger with an exemplary embodiment of the arrangement of reinforcements of the present disclosure of FIG. 1 thereon that further illustrates the relationship with the bones and joints of a finger.
Figure 3:
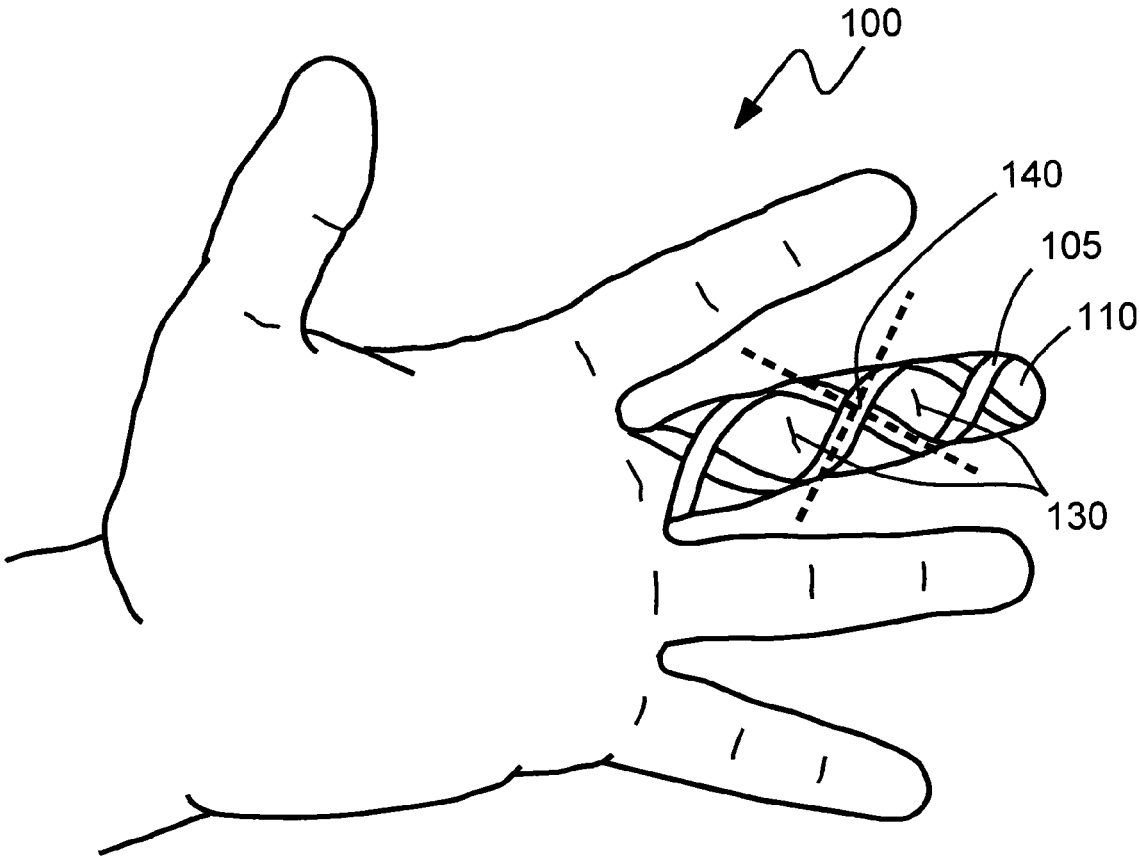
FIG. 3 is a palmar view of a hand with an exemplary embodiment of the arrangement of reinforcements of the present disclosure of FIG. 1 thereon.

Referring to the drawings and, in particular, FIGS. 1-3, an arrangement of continuous reinforcements generally referred to by reference number 100 is shown. In an exemplary embodiment, reinforcements arrangement 100 has at least one reinforcement 105 affixed continuously to one or more fingers 110 of a glove (not shown). Finger 110 has a dorsal surface 115 and a palmar surface 120. Each finger 110 has three phalanges 125, or finger bones, while the thumb has two phalanges 125. Each finger and thumb has one metacarpal 145. An interphalangeal joint 130 separates each phalanx 125, and a metacarpophalangeal joint 150 separates each metacarpal 145 from the first phalanx 125.

As illustrated in FIGS. 1 and 2, reinforcement 105 is affixed continuously to the one or more fingers of a glove to form at least one X-shaped pattern 135 when projected on a plane of motion of interphalangeal joint 130. Reinforcement 105 is located on one or both sides of each interphalangeal joint 130. X-shaped pattern 135 is substantially centered over an axis of rotation of interphalangeal joint 130. In an exemplary embodiment, X-shaped pattern 135 is located over every interphalangeal joint 130 of every finger 110. One particular advantage of reinforcements arrangement 100 is that X-shaped pattern 135 provides freedom of movement of each interphalangeal joint 130.

As illustrated in FIG. 3, reinforcement 105 crosses over palmar surface 120 to form at least one palmar X-shaped pattern 140. Reinforcement 105 also crosses over dorsal surface 115 to form at least one dorsal X-shaped pattern (not shown). Dorsal X-shaped pattern and palmar X-shaped pattern 140 are substantially centered between each interphalangeal joint 130. In FIGS. 1-3, reinforcement 105 is illustrated on the middle finger only and the glove has been omitted for clarity. However, in an exemplary embodiment, reinforcement 105 is affixed to every finger 110 of the hand including the thumb.

Figure 4:
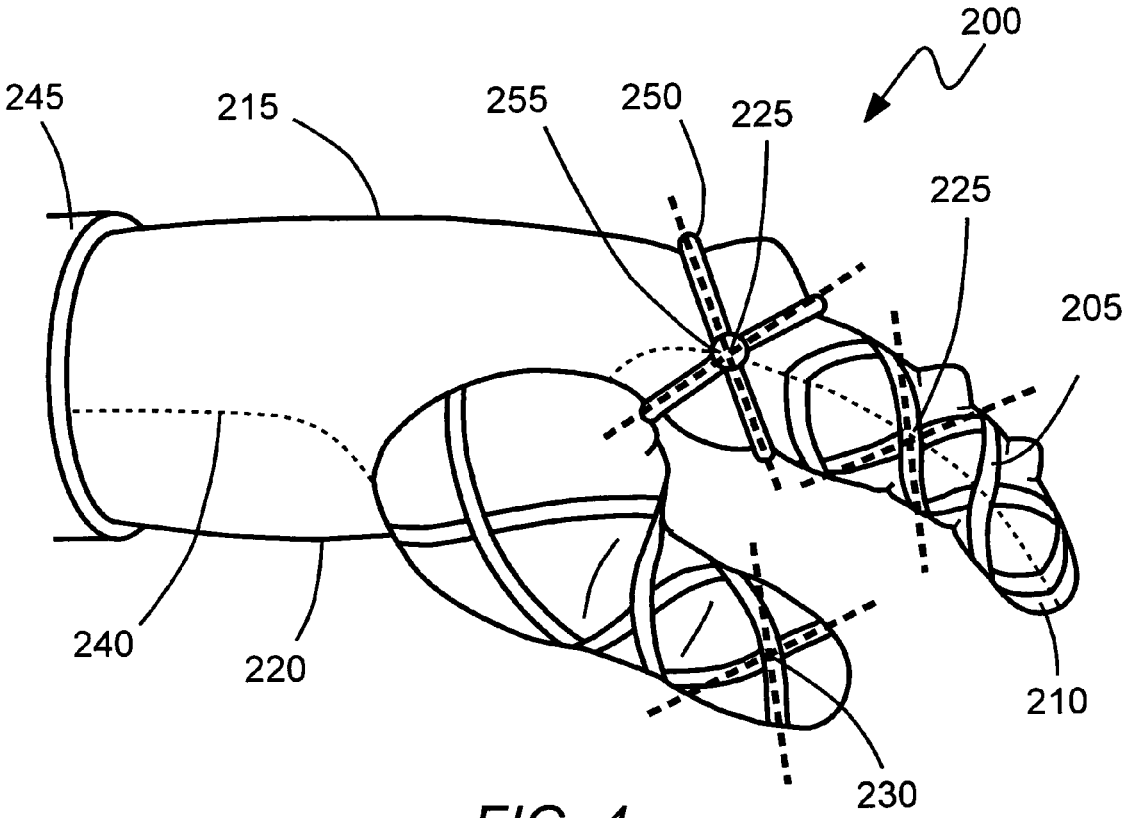
FIG. 4 is a perspective view of a glove with an exemplary embodiment of the arrangement of reinforcements of the present disclosure of FIG. 1 thereon.

Referring to the drawings and, in particular, FIG. 4, a glove for an internally pressurized suit generally referred to by reference number 200 is shown. Glove 200 has at least one reinforcement 205 affixed continuously to at least one glove finger 210. Glove 200 has a dorsal constraint layer 215 and a palmar constraint layer 220. Dorsal constraint layer 215 and palmar constraint layer 220 are made from one or more pieces of fabric or other sheet material.

As illustrated in FIG. 4, reinforcement 205 is affixed continuously to glove finger 210 to form at least one X-shaped pattern 225 when projected on a plane of motion of an interphalangeal joint (not shown) of glove finger 210. Reinforcement 205 is located on one or both sides of the interphalangeal joint. X-shaped pattern 225 is substantially centered over an axis of rotation of the interphalangeal joint. In an exemplary embodiment, X-shaped pattern 225 is located over every interphalangeal joint of every finger 210.

Reinforcement 205 also crosses over dorsal constraint layer 215 to form at least one dorsal X-shaped pattern 230. Reinforcement 205 further crosses over palmar constraint layer 220 to form at least one palmar X-shaped pattern (not shown). Dorsal X-shaped pattern 230 and palmar X-shaped pattern (not shown) are substantially centered between each interphalangeal joint. In an exemplary embodiment, reinforcement 205 is affixed to every finger 210 of the hand including the thumb.

Dorsal constraint layer 215 and a palmar constraint layer 220 are attached along one or more seams 240. Dorsal constraint layer 215 and a palmar constraint layer 220 are further attached to a rigid collar 245 for attachment to an arm of the suit (not shown). In a second exemplary embodiment, reinforcements 205 are affixed to a one-piece glove (not shown) having no seams 240.

In an exemplary embodiment, glove 200 has one or more rigid reinforcing bars 250 that form the same X-shaped pattern 225 that is formed by reinforcement 205. Reinforcing bar 250 has a pivot 255 that provides freedom of movement of each finger joint.

In an exemplary embodiment, reinforcement 205 is a ribbon made from polyester fiber that is stitched to dorsal constraint layer 215 and palmar constraint layer 220. However, reinforcement 205 can be attached to dorsal constraint layer 215 and palmar constraint layer 220 via any known attaching means including, but not limited to, adhesives, bonding and heat sealing.

Figure 5:
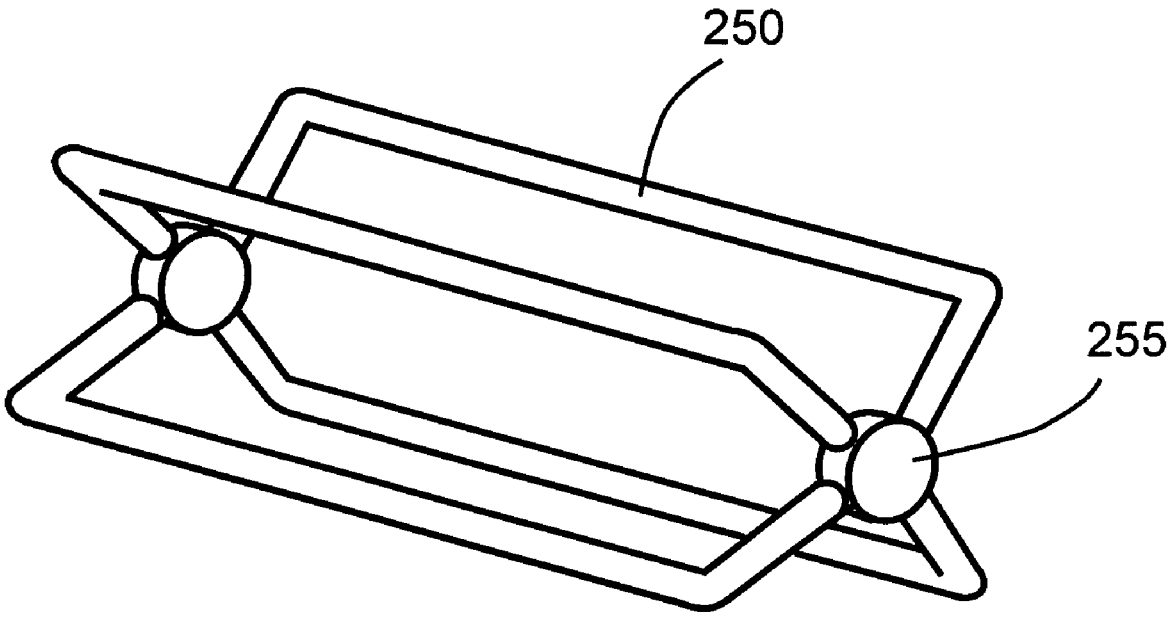
FIG. 5 is a perspective view of a second exemplary embodiment of a method of incorporating an arrangement of reinforcements of the present disclosure of FIG. 1 thereon.

As illustrated in FIG. 5, pivot 255 passes substantially through the center of one or more interphalangeal joints to create an axis of motion. In an exemplary embodiment, reinforcing bar 250 is used around each interphalangeal joint. In a second exemplary embodiment, reinforcing bar 250 is used around all four metacarpophalangeal joints. Reinforcing bar 250 and pivot 255 provide freedom of movement of all four metacarpophalangeal joints, or knuckle joints, simultaneously.

Figure 6:
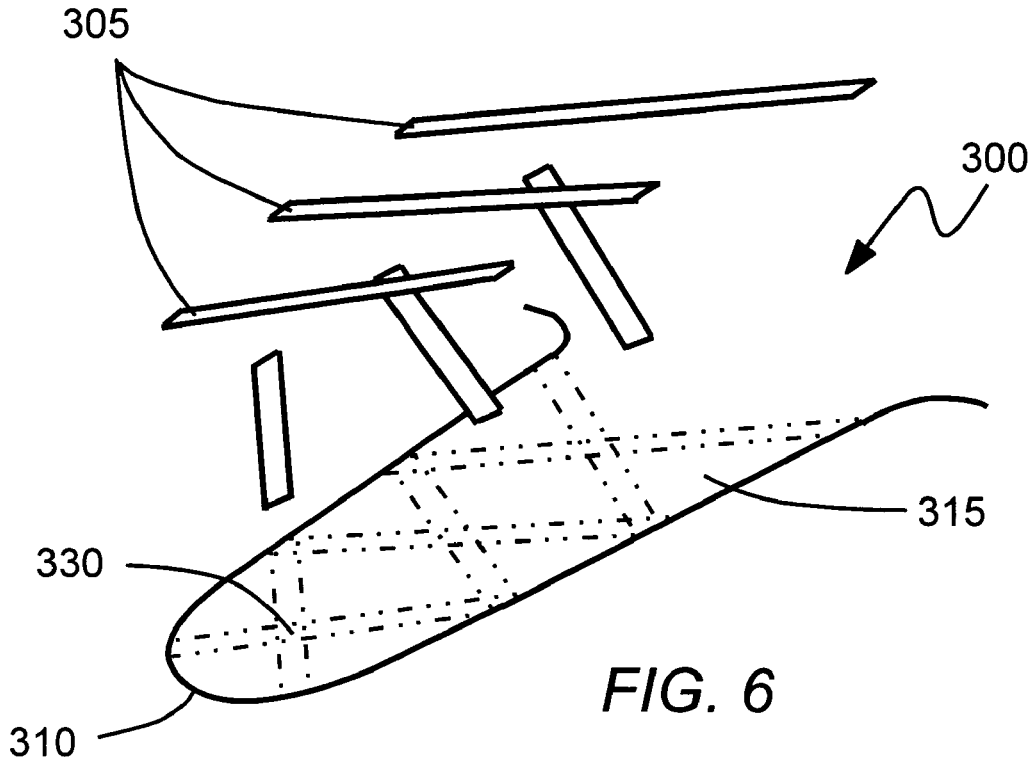
FIG. 6 is a perspective view of a subassembly of a glove finger with an exemplary embodiment of a method of joining the reinforcements on the dorsal subassembly of the glove in FIG. 4.
Figure 7:
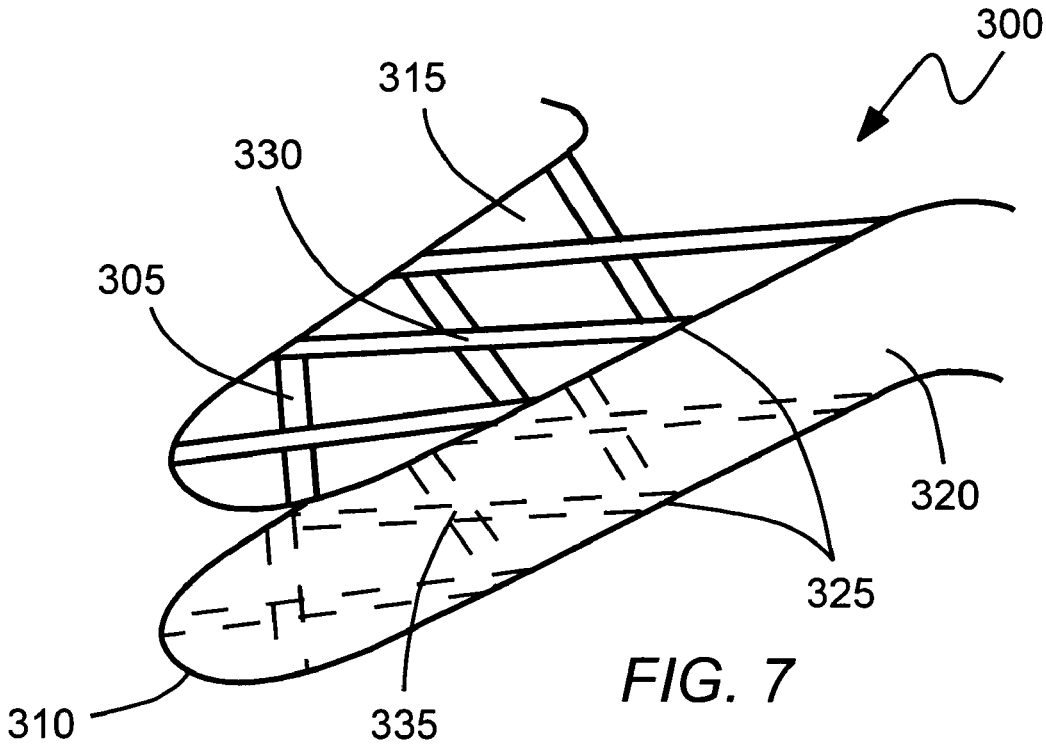
FIG. 7 is a perspective view of a glove finger with an exemplary embodiment of a method of joining a dorsal subassembly with a palmar subassembly of the glove in FIG. 4.

Referring to the drawings and, in particular, FIGS. 6-7, an arrangement of individual reinforcements affixed at discrete points generally referred to by reference number 300 is shown. In an exemplary embodiment, reinforcement arrangement 300 has a plurality of individual reinforcements 305 affixed at discrete points to one or more fingers 310 of a glove (not shown).

In an exemplary embodiment, individual reinforcements 305 are affixed to a dorsal surface 315 of glove finger 310, as illustrated in FIGS. 6 and 7. Reinforcements 305 are also affixed to a palmar surface 320 of glove finger 310. Reinforcements 305 form at least one dorsal X-shaped pattern 330 and at least one palmar X-shaped pattern 335. Dorsal X-shaped pattern 330 and palmar X-shaped pattern 335 are substantially centered between each interphalangeal joint. Other arrangements for affixing reinforcements 305 to dorsal surface 315 and palmar surface 320 to produce an X-shaped pattern when projected on a plane of motion of an interphalangeal joint will be readily apparent to those skilled in the art. Reinforcements 305 affixed to dorsal surface 315 and reinforcements 305 affixed to palmar surface 320 meet at points 325 that correspond to the location of each interphalangeal joint. After reinforcements 305 are attached to dorsal surface 315 and palmar surface 320, dorsal surface 315 and palmar surface 320 are attached together at their outer edges such that corresponding dorsal and palmar reinforcements form an X-shaped pattern when projected on a plane of motion of an interphalangeal joint.

The present disclosure is advantageous because the reinforcements lie along lines on the surface of the finger that do not change length as the finger joint moves through its full range of motion. The reinforcements can perform their intended function without bunching or restricting the bending movement of the fingers. In an internally pressurized glove, the reinforcements restrain the glove finger against axial (distal) elongation but do not restrict its ability to bend. Other possible applications of the X-shaped reinforcements include, but are not limited to, wear resistant reinforcements on work gloves and grip enhancing reinforcements on sports gloves such as for golf, baseball or racket sports. As described in detail below, the reinforcements could be utilized for other articulating joints of a garment.

Figure 8:
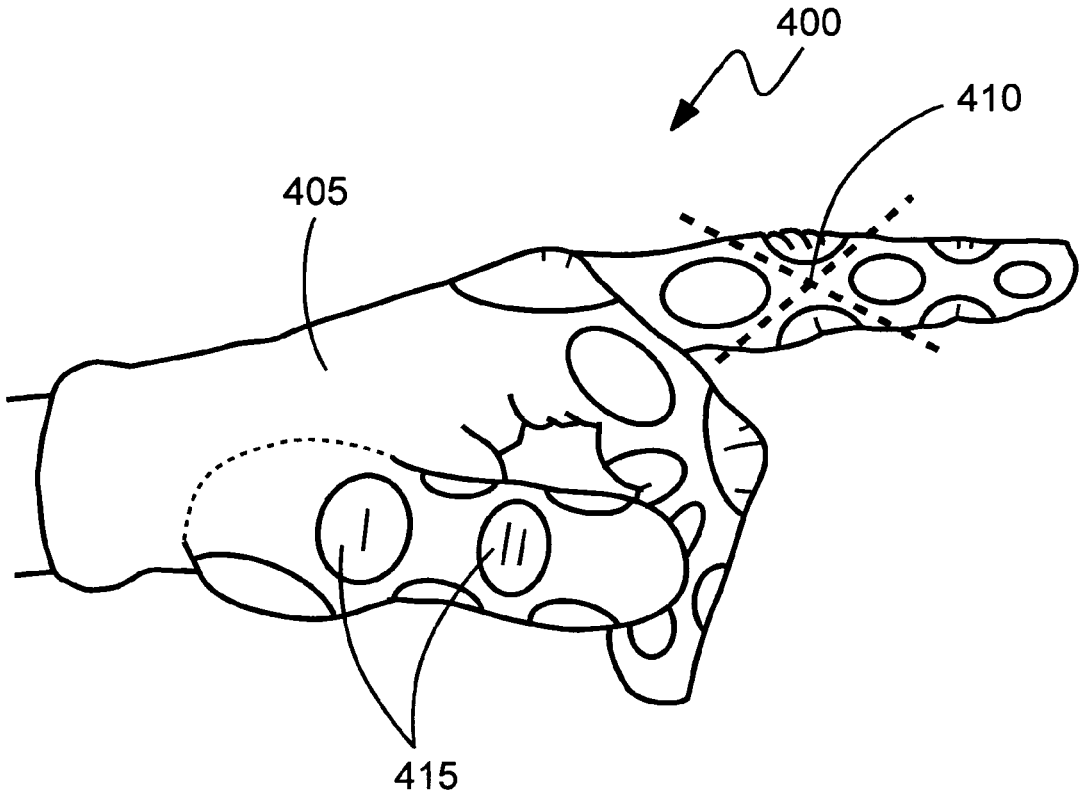
FIG. 8 is a side view of a hand with a second exemplary embodiment of an arrangement of reinforcements of the present disclosure thereon.

Referring to the drawings and, in particular, FIG. 8, a glove generally referred to by reference number 400 is shown. Glove 400 is made from a single layer of sheet material 405. Sheet material 405 has a plurality of cut-out shapes 415 so that the remaining sheet material forms an X-shaped pattern 410 when projected on a plane of motion. X-shaped pattern 410 achieves the same benefits and advantages as the previous embodiments. One advantage of glove 400 is that it enhances gripping friction without restriction of finger articulation or feel. For example, this would be particularly useful for a golf glove or a baseball batting glove.

Figure 9:
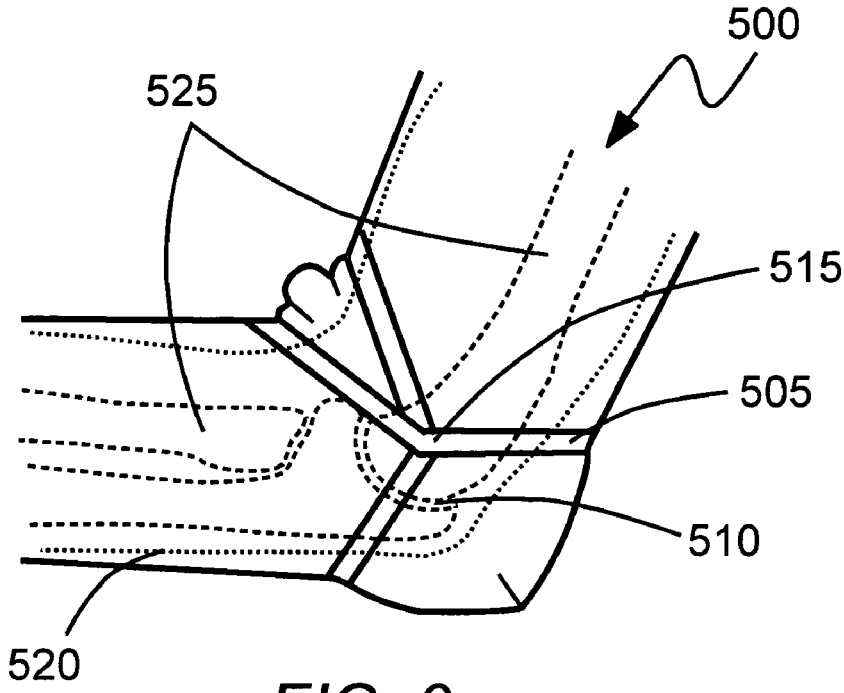
FIG. 9 is a side view of an elbow with an exemplary embodiment of an arrangement of reinforcements of the present disclosure thereon.

Referring to the drawings and, in particular, FIG. 9, an arrangement of reinforcements for use in an elbow joint of an internally pressurized suit generally referred to by reference number 500 is shown. In an exemplary embodiment, reinforcement arrangement 500 has one or more reinforcements 505 that cross over an elbow joint 510 to form an X-shaped pattern 515. In FIG. 9, elbow joint 510 is in the flexed position. FIG. 9 further illustrates an outline 520 and bones 525 for clarity.

Figure 10:
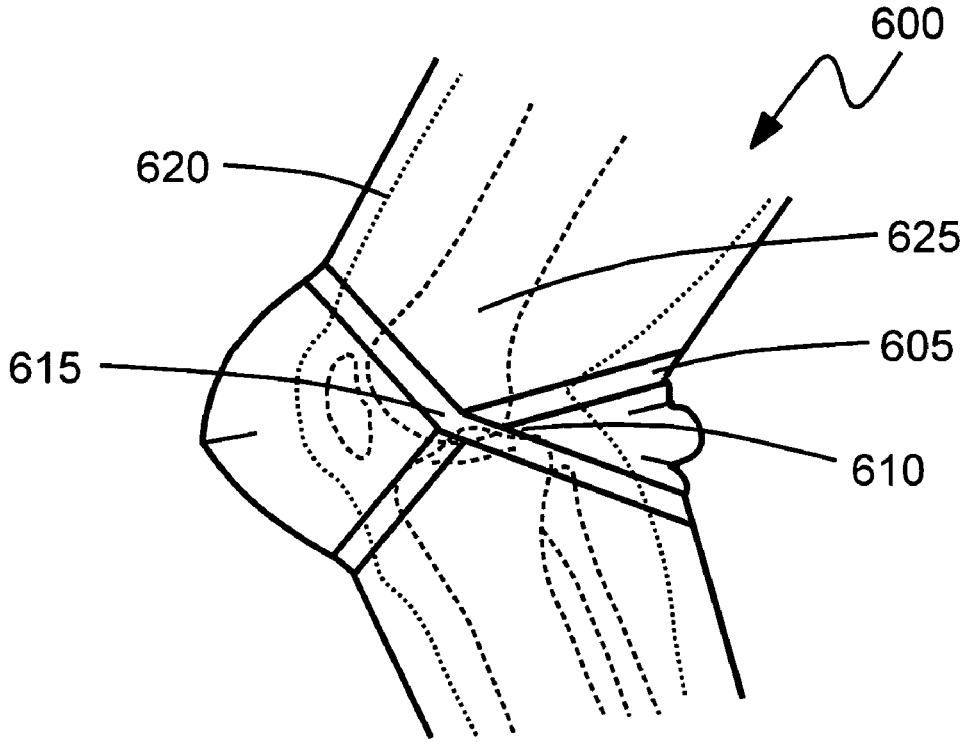
FIG. 10 is a side view of a knee with an exemplary embodiment of an arrangement of reinforcements of the present disclosure thereon.

Referring to the drawings and, in particular, FIG. 10, an arrangement of reinforcements for use in a knee joint of an internally pressurized suit generally referred to by reference number 600 is shown. In an exemplary embodiment, reinforcement arrangement 600 has one or more reinforcements 605 that cross over a knee joint 610 to form an X-shaped pattern 615. In FIG. 10, knee joint 610 is in the flexed position. FIG. 10 further illustrates an outline 620 and bones 625 for clarity.

The present disclosure further provides a method of reinforcing a glove that includes affixing a plurality of individual reinforcements to discrete points on a dorsal surface of a glove. A plurality of individual reinforcements are also affixed to discrete points on a palmar surface of the glove. The edges of the dorsal surface of the glove are attached to the edges of the palmar surface of the glove to form at least one X-shaped pattern when projected on a plane of motion of an interphalangeal joint.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiments disclosed as the best mode contemplated, but that the disclosure will include all embodiments falling within the scope of the appended claims.

What is claimed is:

1. A glove reinforcement that reduces restriction of bending movement of a finger portion of a glove while providing longitudinal restraint of said finger portion of said glove, the reinforcement comprising:

a plurality of resilient reinforcements affixed to said finger portion of said glove, wherein said finger portion comprises a dorsal side and a palmar side, and a proximal direction and a distal direction along a longitudinal axis of said finger portion, said finger portion comprising a plurality of finger joints, wherein a first one of said resilient reinforcements crosses connectedly from a proximal side of one of said finger joints on said palmar side to a distal side of said finger joint on said dorsal side, and a second one of said resilient reinforcements crosses connectedly from a proximal side of said finger joint on said dorsal side to a distal side of said finger joint on said palmar side, crossing said first one of said resilient reinforcements to form an X-shaped pattern, wherein said X-shaped pattern is substantially orthogonal to a bending axis of said finger joint, and wherein said X-shaped pattern is substantially centered over said bending axis of said finger joint.

2. The glove reinforcement of claim 1, wherein said one or more reinforcements cross to form a second X-shaped pattern on said dorsal side of said finger portion, and a third X-shaped pattern on said palmar side of said finger portion.

3. The glove reinforcement of claim 2, wherein said second X-shaped pattern and said third X-shaped pattern are substantially centered between adjacent finger joints.

4. The glove reinforcement of claim 1, wherein said X-shaped pattern is located over each finger joint.

5. The glove reinforcement of claim 1, further comprising a rigid reinforcing bar that forms a fourth X-shaped pattern.

6. The glove reinforcement of claim 5, wherein said rigid reinforcing bar has a pivot that provides freedom of movement of each of said finger joints.

7. The glove reinforcement of claim 5, wherein said rigid reinforcing bar has an axis of rotation that passes substantially through a center of one of said finger joints.

8. The glove reinforcement of claim 1, wherein said one or more reinforcements is a polyester fiber ribbon.

9. A glove reinforcement that reduces restriction of bending movement of a finger portion of a glove while providing longitudinal restraint of said finger portion of said glove, the reinforcement comprising:

a first and second single resilient reinforcement affixed to said finger portion of said glove, wherein said finger portion comprises a dorsal side and a palmar side, and a proximal direction and a distal direction along a longitudinal axis of said finger portion, said finger portion comprising a plurality of finger joints, wherein said first single resilient reinforcement crosses connectedly and continuously from a proximal side of one of said finger joints on said palmar side to a distal side of said finger joint on said dorsal side, and said second single resilient reinforcement crosses connectedly and continuously from a proximal side of said finger joint on said dorsal side to a distal side of said finger joint on said palmar side, crossing said first single resilient reinforcement to form an X-shaped pattern, wherein said X-shaped pattern is substantially orthogonal to a bending axis of said finger joint, and wherein said X-shaped pattern is substantially centered over said bending axis of said finger joint.

* * * * *